United States Patent [19]

Bannister et al.

[11] Patent Number: 4,912,866

[45] Date of Patent: Apr. 3, 1990

[54] DISPLAY FRAME

[75] Inventors: Brian C. Bannister, North Mymms; James N. Morgan, London, both of England

[73] Assignee: Marler Haley Exposystems Limited, Hatfield, England

[21] Appl. No.: 195,727

[22] Filed: May 18, 1988

[30] Foreign Application Priority Data

May 22, 1987 [GB] United Kingdom ..... 8712171

[51] Int. Cl.[4] ..... G09F 7/00

[52] U.S. Cl. ..... 40/605; 40/124.1; 40/152; 40/653; 40/612

[58] Field of Search ..... 40/152.2, 152, 605, 40/606, 124.1, 612

[56] References Cited

U.S. PATENT DOCUMENTS

| | | | |
|---|---|---|---|
| 1,418,261 | 5/1922 | Householder | 40/152.1 |
| 1,822,492 | 9/1931 | Lamb | 40/152.1 |
| 4,034,463 | 7/1977 | Ryan | 40/605 |
| 4,214,392 | 7/1980 | Virsen | 40/606 |
| 4,785,565 | 11/1988 | Kuffner | 40/605 |

*Primary Examiner*—Kenneth J. Dorner
*Assistant Examiner*—Wenceslao J. Contreras
*Attorney, Agent, or Firm*—Parmelee, Miller, Welsh & Kratz

[57] ABSTRACT

A display structure is disclosed comprising rectangular panels each having at its upper edge a cross member (7) providing an upwardly open channel (80) which receives a central formation (68) of a retaining member (54) which provides, at its upper end, on opposite sides, respective downwardly open channels (60). In a lowered position of the retaining member, the outer wall (62) of each channel (60) extends on the outer side of the member (7) and can serve to retain the upper edge of a respective display card fitted in the panel. The releasing member can be raised, then tilted, while being held captive on the member (7) by an enlarged lower end part (76, 78) of the central formation which cannot pass between flanges (82) on member (7), to a position to one side of the respective side face of member (7) to allow vertical insertion or removal of the display card or the like. The central formation (68) may also provide an upwardly open channel (72) to receive a downwardly extending tongue on a similar panel, whereby similar panels may be fitted one on top of the other. The panels may have catch members (20, 100) for engagement in cutouts (112) in such tongues to hold together panels thus fitted one on top of the other.

6 Claims, 8 Drawing Sheets

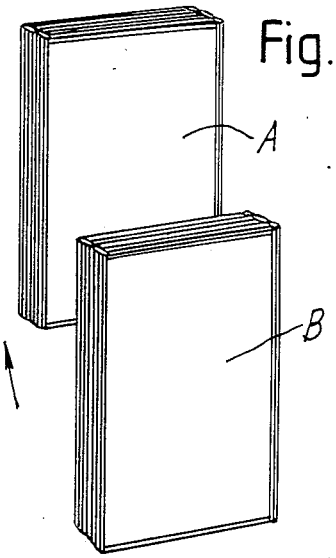
Fig. 2a.
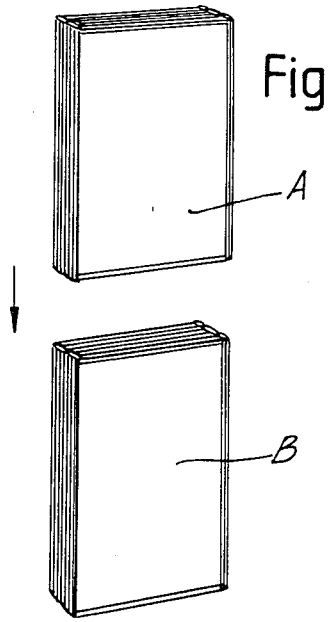
Fig. 2b.
Fig. 3.
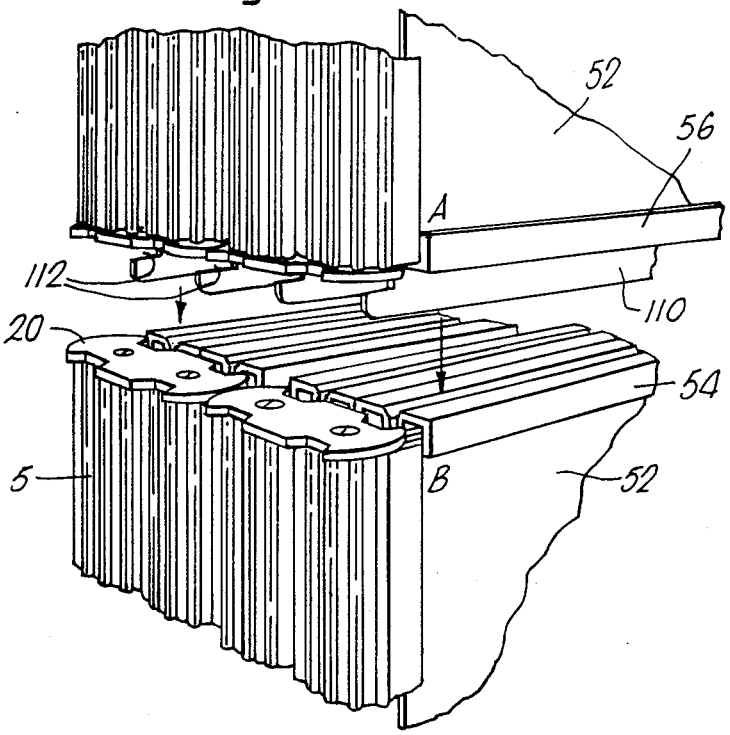

Fig.9a.
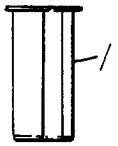
Fig.9b.
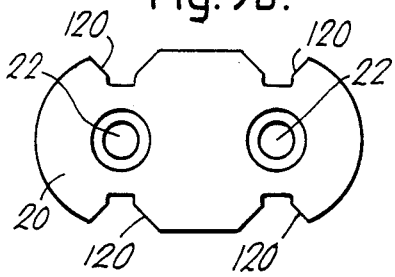
Fig.9c.
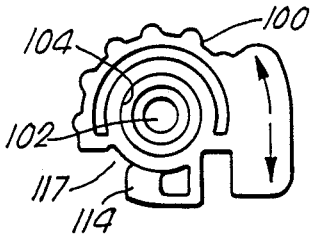
Fig.9d.
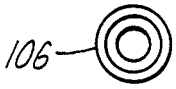
Fig.10a.
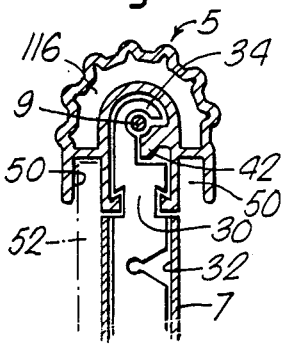
Fig.10b.
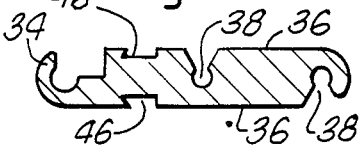
Fig.10c.
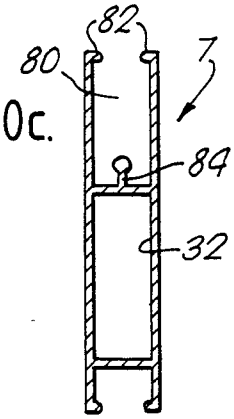
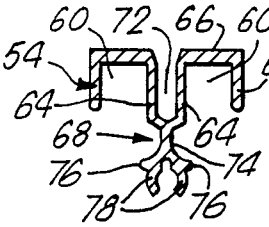
Fig.10d.

DISPLAY FRAME

THIS INVENTION relates to display frames and the like suitable for use in temporary exhibition or advertising displays and the like.

It is an object of the invention to provide an improved display of this character.

According to one aspect of the invention, there is provided a display panel comprising two spaced-apart uprights connected by upper and lower cross-members, the uprights providing on at least one side thereof opposed channels to receive opposite edges of a rectangular sheet fitted between the uprights across the cross members, the lower cross-member providing, or carrying a member providing, an upwardly open channel to receive the lower edge of such a sheet and the upper cross member providing a central upwardly open channel to receive a central formation of a displaceable retaining member extending upwardly from said channel and affording, outside said central channel, a downwardly open channel to receive the upper edge of such a sheet and the adjacent side wall of said central channel of the upper cross member, the side , walls of said central channel having inwardly directed flanges along their upper edges and said central formation of said displaceable retaining member being so dimensioned as to be held captive in said central channel by said inwardly directed flanges but to allow lateral tilting of said displaceable retaining member in the upper region of said upwardly open channel, so as to have clearance, in the tilted position, for insertion of such a rectangular sheet to have its edges retained in said channels of the uprights, the retaining member being thereafter returnable to an upright position for lowering into said central channel to extend said channel of the 1 retaining member over the upper edge of said sheet.

The terms such as upper and lower, upwardly and 1 downwardly, etc. used in the above and hereinafter are used for convenience and it will be appreciated that an inverted arrangement may be equally viable, that is to 1 say an arrangement in which "upper" and "lower", "upwardly" and "downwardly" etc. are transposed.

Figure 6:
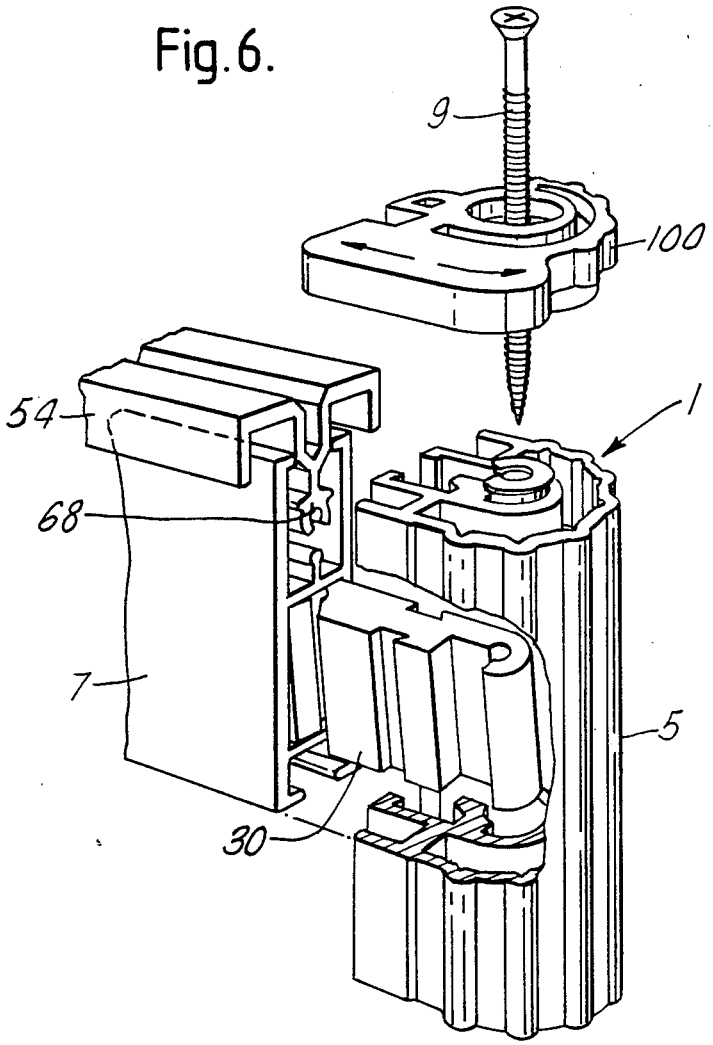
Figure 7:
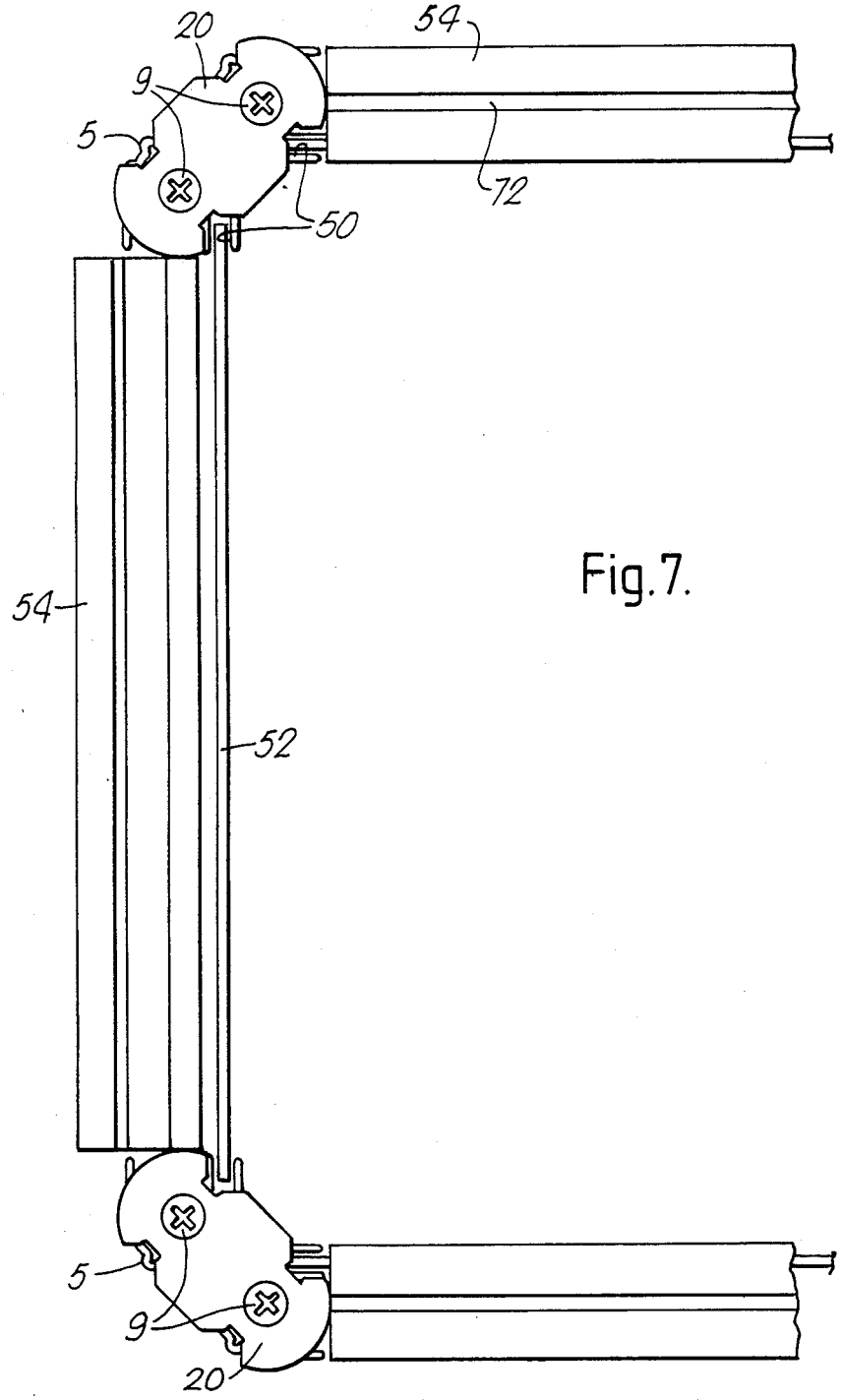

According to another aspect of the invention, there is provided a display unit comprising at least two units, each of which comprises a plurality of rectangular panels pivotally connected edge to edge, one such unit being superimposed upon the other, with each panel of the upper unit being placed upon, and co-planar with, a respective panel of the lower unit; adjoining edges of the superimposed units providing respectively a projecting tongue or strip and a channel or slot receiving the same, opposing end parts of respective upright edge portions of superimposed panels being in plug-and-socket interengagement with one another, and having associated there-with respective rotary catch members engaging in slots provided adjacent the ends of said strips to prevent vertical separation of the units and rotatable so as to be out of engagement with said slots to permit vertical separation of the units. An embodiment of the invention is described below by way of example with reference to the accompanying FIG. 1 shows in perspective, views of a display structure embodying the invention in various positions, FIG. 2*a* and FIG. 2*b* show successive stages in the assembly of the structure of FIG. 1, FIG. 3 a perspective view showing a detail during the assembly procedure of FIGS. 2*a* and 2*b*, FIG. 4 a perspective view showing a detail of the opposite edge of the structure during the assembly procedure of FIGS. 2*a* and 2*b*, FIGS. 5 and 6 exploded perspective views showing details of the display structure of the foregoing figures, FIG. 7 is a fragmentary plan view and FIG. 8 a fragmentary perspective view of the display structure, FIGS. 9*a* to 9*d* are views of various components of the structure, FIG. 10*a* is a view in horizontal section of an edge portion of one panel of the structure, and FIGS. 10*b* to 10*d* are cross sectional views of further components of the structure formed as extrusions.

Figure 1:
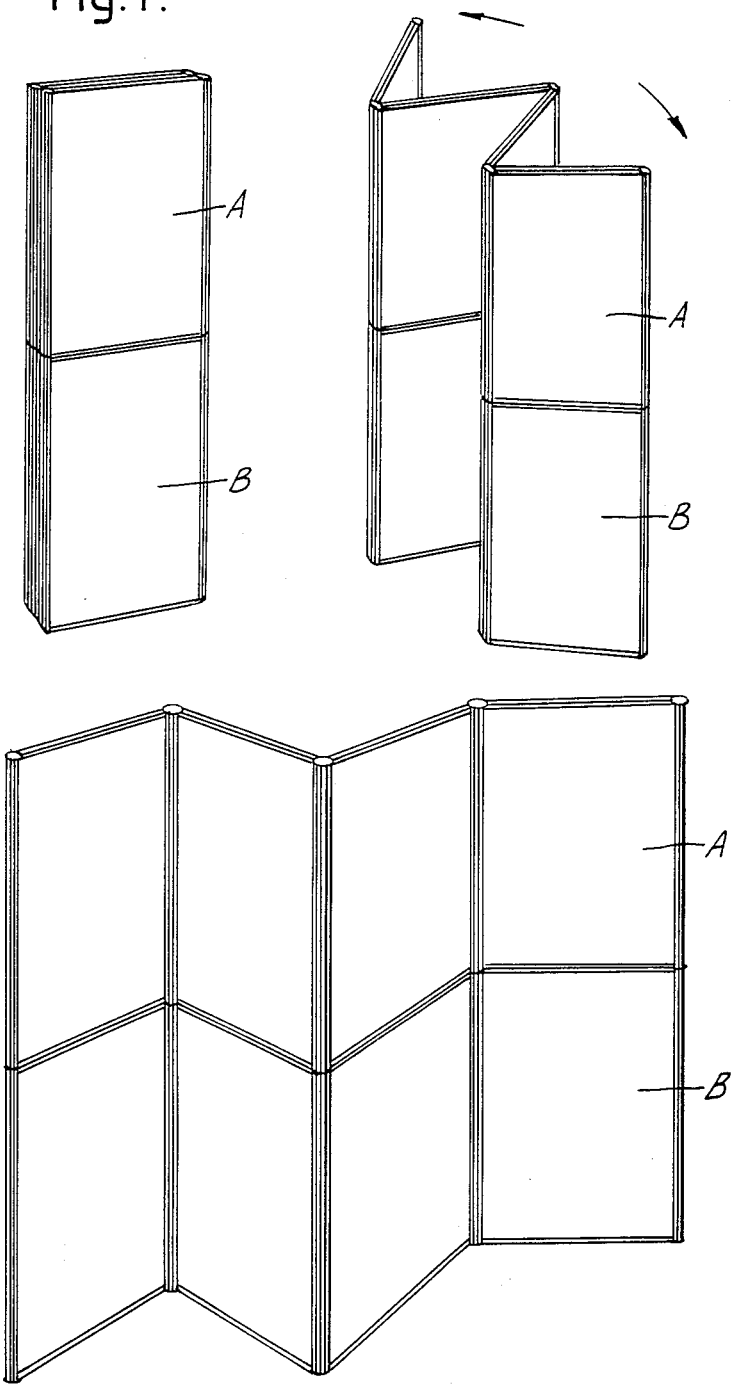

Referring to FIG. 1, the display structure shown comprises four flat rectangular major leaves, pivotally interconnected, vertical edge to vertical edge, and each leaf comprising an upper rectangular panel and lower rectangular panel. The structure illustrated is formed by detachably interconnecting two identical units, one such unit A providing the four pivotally interconnected upper panels and the other such unit B comprising the four pivotally interconnected lower panels.

The pivotal interconnection between adjoining vertical edges of adjoining panels in each unit is effected in a manner similar to that described in detail in our British Patent No. 1542244, with the vertical edges of the panels being afforded by extruded aluminium alloy members 5 of the cross sectional form shown in FIG. 10*a* affording an outer contour having the form of a 180° segment of a toothed gear, with the teeth of adjoining members 5 in the assembly intermeshing after the fashion of gear teeth. Adjoining gear-toothed side members 5 thus intermeshed are furthermore held together and in mesh with one another by means of connecting plates 20 (see FIGS. 3, 4, 5, 7, 8, and 9*b*) at the ends of the intermeshed members, each connecting plate 20 spanning the interconnected members and having two spaced-apart holes 22 which define pivotal axes of the plates 20 with respect to the gear-toothed members 5 and which receive fixing screws 9 which are extended axially into the respective gear-toothed members to secure the plates 20 in place so that the pivotal axes of the plates , 20 with respect to the gear edge members coincide with the respective axes of the respective gear profiles As described in more detail in our British Patent No. 1542244, the result of this arrangement is that the panels forming each unit can be folded against one another in a zig zag fashion so as to lie flat and in face to face contact (see FIGS. 3 and 4) and yet can be pivoted apart from one other to any desired extent, with the adjoining panels lying substantially in a common plane when the various hinged joints are fully opened out.

Figure 5:
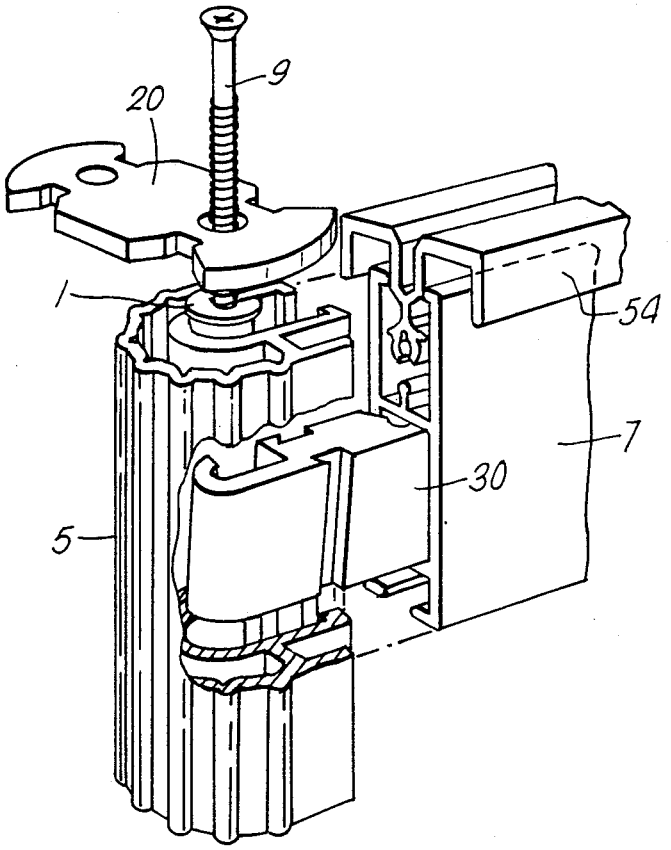

Each panel of each unit comprises a substantially rectangular peripheral frame formed by two uprights or verticals 5 constituted by extruded lengths of the section shown in FIG. 10*a* and upper and lower horizontal members 7 formed by extrusions of the cross section shown in FIG. 10*c* . As shown in FIGS. 5 and 6, the uprights 5 and horizontals 7 are connected by means of connecting members 30, formed by short sections cut from an extrusion of the cross section shown in FIG. 10*b*, such as to fit, in the manner shown, as a close fit within a rectangular channel 32 afforded by the extrusion of FIG. 10*c*. The member 30 has at one end a 1 hook formation 34, the portion of the member 30 adapted to fit within the channel 32 having opposite parallel the channel 32, this portion of the member 30 being 11 provided with spaced apart grooves or channels 38 each 1, including a root portion having the form of a sector, over substantially more than 180°, of a cylindrical bore and which, when the member 30 has been appropriately fitted within the channel 32 at one end of a horizontal member 7, receives a respective self-tapping fixing screw, or possibly merely a localised indentation formed in the lower wall of the channel 32 as viewed in FIG. 10*c* by a punching or rivetting operation.

As shown in FIG. 10*a*, somewhat schematically, the hook formation 34 and adjoining regions of the member 30 are of a cross sectional form to fit closely within a central inner channel of the extrusion forming the upright 5 (FIG. 10*a*) leaving, defined between the arcuate inner surface of the hook formation 34 and an opposing arcuate surface provided by a rib 42 projecting inwardly into the inner channel of the upright extrusion, a generally cylindrical passage which receives the shank of the respective securing screw 9. The crest diameter of the self-tapping screw thread of the screw 9 is somewhat greater than that of the last-noted substantially cylindrical passage, so that the thread of the screw 9 cuts into the opposing surfaces of hook formation 34 and rib 42 defining said substantially cylindrical 1 passage and at the same time, the screw 9 acts as a wedge to draw the member 30 radially with respect to the longitudinal axis of the gear edge member 5 and thereby 1 the opposing free edges of the walls of the inner channel of the gear edge member 5, thereby locating the horizontal 7 firmly with respect to the upright 5. It will be noted that the member 30 has, in its opposite faces, .1 opposing grooves 46 which receive inwardly turned flanges at the free edges of the side walls of the inner channel of the upright extrusion 5. In a variant, the grooves 46, instead of being formed in the extrusion, are cut in the body of the member 30 after the latter has been cut from the extrusion, or alternatively narrow grooves formed in the extrusion may be enlarged after cutting the member 30 from the extrusion, so as to be slightly inclined with respect to the vertical, in such a way as to provide a wedging action when the member 30, attached to the respective horizontal 7, is forced into the 4 upright extrusion 5 along the axis of the latter, thereby to render the structure more secure.

As will be appreciated from FIG. 10*a*, the cross members 7 are substantially narrower than the uprights 5, being of substantially the same width as the inner channels of the uprights 5. The extrusion forming the uprights 5 defines, on either side of the inner channel, side channels 50 which receive, in the assembled unit, the edges of rectangular cladding sheets 52, for example of sheet plastics or the like. At the upper and lower end of each panel of unit A or B, such cladding panels 52 are received respectively in downwardly and upwardly directed channels afforded by extruded members 54, 56 described in more detail below. It will be appreciated that the cladding panels 52 are omitted in FIGS. 5 and 6 for the sake of clarity. The upper members 54 are each formed by a length cut from an extrusion of the cross section shown in FIG. 10*d* (see also FIG. 8). The cross section of FIG. 10*d* forms two side by side channels 60 (for receiving cladding panels 52 on opposite sides of the members 7) each defined by an outer wall 62, an inner wall 64 and a base 66. At the lower edges, the inner walls 64 are connected by respective webs to a central formation 68 extending downwardly therefrom. The two inner walls 64 define between them, on the upper side of the extrusion cross section, an upwardly open channel 72. The formation 68 comprises a vertical web portion 74 extending downwardly from the junction of the side walls 64, an enlarged portion at the lower end of the portion 74 and including laterally projecting ribs 76, below which extend two arcuate formations 78 defining between them a downwardly open central channel of part-circular cross section, with a relief slot extended into the body of the formation 68 from the upper region of the part-circular cross-section channel, to allow resilient springing-apart and together of the formations 78.

It will be noted from FIG. 10*c* that the extrusion forming the upper cross members 7 affords an upwardly open channel 80 the side walls of which have inwardly directed flanges 82 at their free upper ends, the channel 80 having a base wall from the middle of which extends upwardly a central flange 84 which terminates in a part-cylindrical bead. The width of the formation 68, as measured between the free edges of the lateral ribs 76, is only slightly less than the spacing between the side walls of the channel 80 and is greater than the spacing between the free edges of the flanges 82. The spacing between the faces, furthest from each other, of the inner side walls 64, on the other hand, is somewhat less than the spacing between the inner edges of the flanges 82. Accordingly, the portion of the extrusion of FIG. 10*d* afforded by the inner walls 64, web 74 and formation 68 can be accommodated freely within the channel 80 when the upper member 54 is slid longitudinally into the channel 80 of the cross member 7 during assembly of the panel so that, as shown in FIGS. 3 and 6, for example, the base walls of the channels 60 extend over the flanges 82 and the outer walls 62 extend downwardly on the outer sides of the side walls of the channel 80, and lie, in this position, substantially in the same planes as the webs the uprights 5. When the member 54 is pressed fully downwardly into the channel 80, the part-cylindrical bead along the upper edge of the flange 84 is received as a snap-fit within the part-cylindrical channel defined by the formations 78 (FIG. 10*d*), whilst the bases 66 of the channels 60 engage or closely adjoin the upper surfaces of the flanges 82. By pulling the member 54 directly upwardly, the formation 68 can be disengaged from the flange 84, but such upward movement will be limited by engagement of the ribs 76 with the undersides of the flanges 82.

Figure 8:
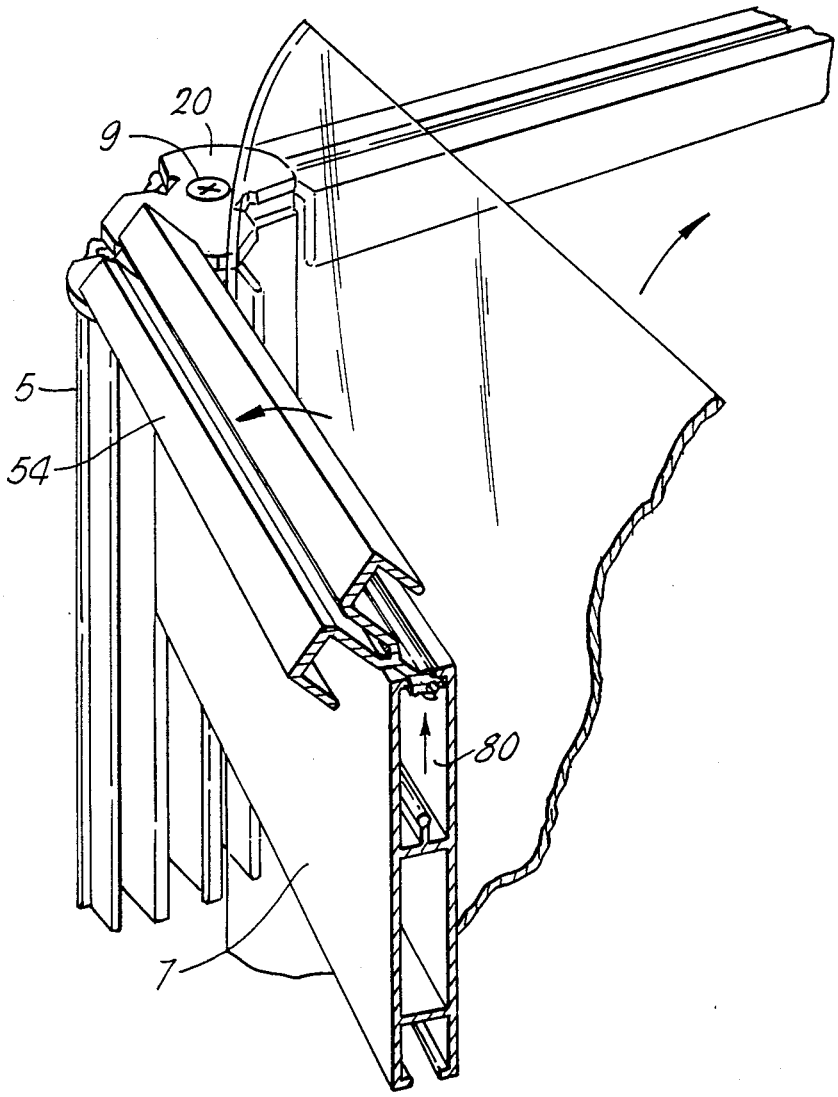

The dimensions of the web 74 and the portions of the extrusion of FIG. 10*d* directly above the outer edges of the ribs 76 are so dimensioned in relation to the flanges 2 and the spacing between the free edges of the latter that if the member 54 is drawn upwardly in the channel 80, without tilting, until the ribs 76 engage the undersides of the flanges 82, and then the member 54 is tilted laterally, as illustrated in FIG. 8, with simultaneous slight lowering of the member 54, the rib 76 which is moved uppermost by such tilting is simultaneously moved inwardly, away from the adjoining side wall of the channel 80, sufficiently to pass the inner edge of the adjoining flange 82. However, further tilting or upward removal of the member 54 is then prevented by engagement of the outer surface of the formation 78 which become uppermost as a result of such tilting with the underside of the adjoining flange 82 (see FIG. 8).

The weights of the respective parts of the extrusion of FIG. 10*d* and the dimensions of the web 74, are such that, in this tilted position, the member 54 will rest under gravity in the tilted position, with the flange, which connects the inner wall 64 on the lower side with the web 74, resting on the top of the adjoining flange 82. The outer surfaces of the web 74 and the upper surfaces of the formation 68 above the ribs 76 merge together over concavely curved regions so formed as to ensure a camming action with the flanges 82 when the member 54 is raised and tilted, ensuring the gradual lowering on one side of the rib 76 as the member 54 is tilted, automatically, without any conscious control by the operative. Tilting of the members 54 to the position shown in FIG. 8 leaves the member 54 displaced entirely to the inner side of the plane of the outer surfaces of the cross-members 7 on the highest side of the member 54, thereby allowing a rectangular sheet of paper, flexible card or the like bearing advertising or informative matter or the like to be slid downwardly, as illustrated in FIG. 8, past the member 54, with its edges accommodated between the respective cladding sheet 52 and the outer walls of the outer channels of the uprights 5. The central member 54 in FIG. 7, i.e. that shown in full, is also in the tilted position and it will be noted that the respective cladding sheet 52 is fully exposed. When such a sheet has been thus fitted in place, with, of course, its upper edge lying substantially at the upper edge of the respective cross members 7 and its lower edges accommodated within the respective channels presented (see below) by the respective lower member 56, the member 54 can be tilted back into its normal position and pressed downwardly to clip the formation 68 around the bead of the flange 84.

A spacer member 1, shown in perspective in FIGS. 5 and 6 and in side elevation in FIG. 9*a* is fitted in the upper end of the central channel of the upright extrusion 5 after insertion of the member 30 of the upper horizontal 7, (and into the lower end of the upright extrusion 5 after insertion of the member 30 of the lower horizontal 7), the member 1 having a part-cylindrical form adapted to fit within the arcuate base portion of ht. Member 1 has a flange around its upper end which engages the end face of the upright in which member 1 is inserted. The screws 9 are passed through respective central passages defined by the members 1 before entry into the spaces defined between the hook formations 34 and the opposing surfaces of the ribs 42. The members 1 act primarily as spacers to ensure accurate location of the members 30, but the upper surfaces of the members 1 also act as bearing surfaces for the connecting plates 20.

The uprights 5 at either end of each unit of pivotally interconnected panels, i.e. the uprights 5 which are not meshed with adjoining uprights 5, are covered, at their upper and lower ends, by end caps 100 (see FIG. 9*c*) which have central apertures 102 to receive fixing screws 9 which, like the fixing screws 9 securing the plates 20, are extended axially through respective spacers 1 into the bores defined between the hook formations of the respective members 30 and the cooperating portions of the inner ribs 42. Each end cap 100 has, on that face thereof which is presented upwardly (in the case of a cap 100 at the upper end of its upright) and downwardly (in the case of a cap 100 at the lower end of its upright), a circular recess 104. In the case of the caps 100 at the upper ends of their uprights, the heads of the fixing screws 9 are received within respective further countersunk recesses at the bottoms of the recesses 104. In the case of the caps 100 at the lower ends of the uprights 5, there is located within each recess 104 an annular spacer member 106 (shown in plan in FIG. 9*d*) having a thickness or depth almost twice that of the recess 104 and which therefore projects axially from the recess 104. The fixing screws 9 at the lower ends of the uprights are passed axially through the members 106 as well as through the caps 100, spacers 1, etc.

When an upper and lower unit are fitted together in the manner shown in FIG. 1, the projecting portions of the members 106 at the lower end of the upper unit are received in and locate in the recesses 104 of the caps 100 at the upper ends of the uprights of the lower unit, thereby preventing transverse displacement of the up rights of the upper unit relative to the uprights of the lower unit. Furthermore, the members 56 at the lower ends of the units have vertical plates or strips 110 extending downwardly therefrom which, when the upper unit is superimposed upon the lower unit as shown in FIG. 1, are received within the respective upwardly presented channels 72 of the upper members 54 of the lower unit. The members 56 may be extrusions of the same cross section as the members 54, i.e. that illustrated in FIG. 10*d*, with the strips 110 being inserted in the channels 72 of the members 56 and fixed therein, for example by adhesive, welding or the like. Alternatively, the strips 110 may be formed integrally with the remainder of the members 56, by forming the latter as extrusions of a cross section corresponding substantially to the combination of that of FIG. 10*d* with strips 110 inserted in the channel 72.

Figure 4:
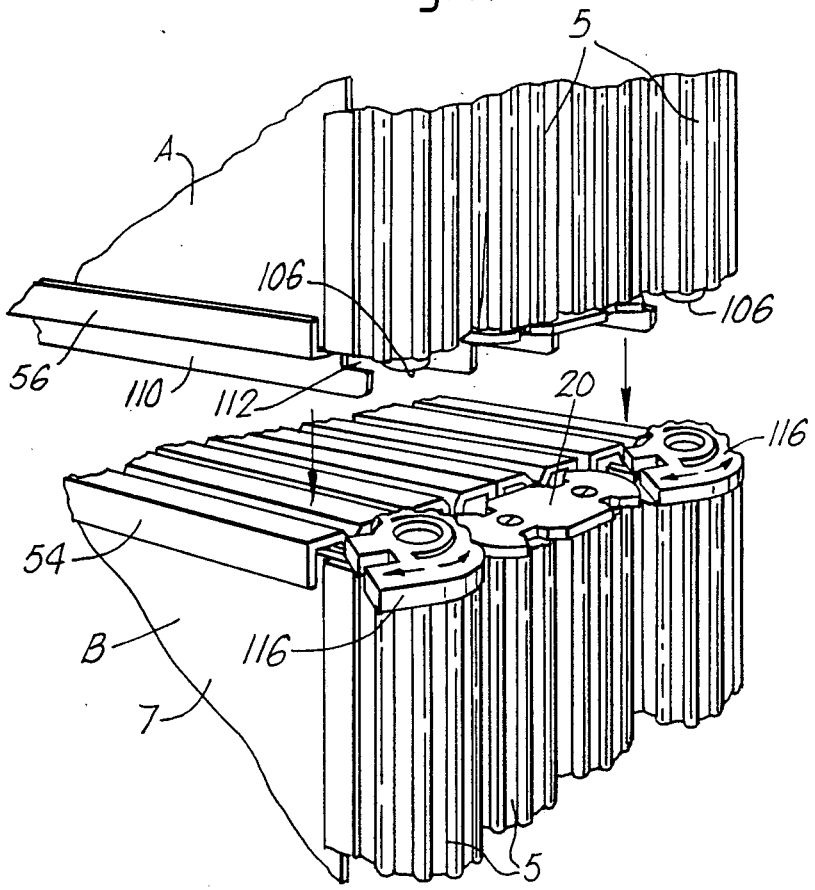

At their ends, the strips 110 extend partially beyond the ends of the respective horizontal members 7 over which they are fitted into the region of the inner channels of the respective uprights 5, and thus extend beyond the ends of the channels 60, and each strip 110 at its ends is formed with a cut-away or slot 112. It will be noted from FIG. 9*c*, for example, that each end cap 100 has a radially projecting tab 114, and, adjoining the latter, a cut-out 117. On its underside (in the case of the caps 100 at the upper ends of uprights 5) each cap 100 has an arcuate projection which is received within the space 116 defined immediately radially inwardly of the toothed periphery of the extrusion 5 and which space is terminated circumferentially by the base walls of the channels 50. The last-noted projection operating in the space 116 acts as a stop whereby rotation of the cap 100 about the axis of the respective upright 5 is limited to movement between a first limiting position in which the cut-out 117 is aligned with and forms an extension of the mouth of the channel 80 of the cross member 7 and a second position in which the tab 114 is aligned with the channel 80 in the cross member. Assuming the upper caps 100 of the lower unit B are in their first position, and both units are in a folded-flat, zig-zag configuration, all as shown in FIG. 4, vertical insertion of the respective strips 110 of the upper unit into the respective channels 70 of the lower unit is possible, in such manner that the projecting members 106 of the upper unit fit within the recesses 104 of the uppermost caps 100 of the lower unit B. After the upper unit A has thus been lowered into place on the lower unit B, the caps 100 of the lower unit may then be rotated into their second positions in which the tabs 114 lie within the slots 112 thereby preventing upward removal of the upper unit A from the lower unit B.

It will be noted from FIG. 9*b* that the plates 20 have respective cut outs 120 corresponding in form to the cut-outs 117. These cut-outs 120 are aligned with the respective upright channels 80 only when the panels of the unit are folded flat against one another in zig-zag in this position, the plates 20 do not interfere with the passage of the projecting end portions of the respective strips 110 associated with the intermediate panels, when an upper unit A (also in a folded flat, zig-zag, condition) is lowered onto the correspondingly folded lower unit B. However, as the thus superimposed units are jointly opened out by hinging about the adjoining vertical edges as shown in FIG. 1, the peripheral portions of the plates 20 adjoining the cut-outs 120 swing into the cut-outs 112 (see, for example, FIG. 7) preventing subsequent upward removal of the upper unit A from the lower unit B. That is to say, an upper unit may only be fitted on a lower unit, or removed therefrom, with both units in a folded flat, zig-zag configuration. As previously noted, both units are identical in configuration, so that either can readily be fitted on top of the other. It will be appreciated, of course, that if desired, a further identical unit may be fitted upon the unit A, thus providing a three tiered construction, and so on.

It will be noted from FIG. 7, that in the position shown therein, the cut-outs 120 register with the channels 50 on the inner sides of the (right) angles between adjacent panels, and this is the position adopted for fitting, removing or replacing rectangular information or advertising sheets into the panels after tilting the upper members 54, as described above The features disclosed in the foregoing description, in the following claims and/or in the accompanying drawings may, both separately and in any combination thereof, be material for realising the invention in diverse forms thereof.

We claim:

1. In a display panel comprising two spaced-apart uprights connected by upper and lower cross-members, the uprights providing on at least one side thereof opposed channels to receive opposite edges of a rectangular sheet fitted between the uprights across the cross members, the lower cross-member providing, or carrying a member providing, an upwardly open channel to receive the lower edge of such a sheet, the improvement comprising: a displaceable retaining member, having a central formation, with the upper cross member providing a central upwardly open channel to receive the central formation of said displaceable retaining member, extending upwardly from said channel and affording, outside said central channel, a downwardly open channel to receive the upper edge of such a sheet and the adjacent side wall of said central channel of the upper cross member, the side walls of said central channel having inwardly directed flanges along their upper edges and said central formation of said displaceable retaining member being so dimensioned as to be held captive in said central channel of said upper cross member by said inwardly directed flanges but to allow lateral tilting of said displaceable retaining member in the upper region of said upwardly open channel, so as to have clearance, in the tilted position, for insertion of such a rectangular sheet to have its edges retained in said channels of the uprights, the retaining member being thereafter returnable to an upright position for lowering into said central channel to extend said channel of the retaining member over the upper edge of said sheet.

2. A display panel according to claim 1 wherein said central formation of said retaining member is provided with a rib and adjoining groove whereby the retaining member can rest, in said tilted position, with said rib extending through the space between said flanges and bearing upon one of said flanges, to maintain the retaining member in said tilted position under its own weight.

3. A display panel according to claim 2 wherein said upper cross member provides within said central upwardly open channel and extending centrally upwardly therein, a first part of a releasable snap-fit fastener means, and said central formation of said retaining member is provided with a second part of said releasable snap-fit fastener means, whereby towards the end of a lowering of the retaining member into said upwardly open channel, the first and second parts of said snap-fit fastener means interengage to maintain the retaining member releasably in said lowered position.

4. A display panel according to claim 1 wherein said upper cross member provides within said central upwardly open channel and extending centrally upwardly therein, a first part of a releasable snap-fit retaining member is provided with a second part of said releasable snap-fit fastener means, whereby towards the end of a lowering of the retaining member into said upwardly open channel, the first and second parts of said snap-fit fastener means interengage to maintain the retaining member releasably in said lowered position.

5. A display structure comprising: at least two units, each unit comprising a plurality of rectangular panels pivotally connected edge to edge, one said unit being superimposed upon the other with each panel of said plurality of panels of the upper unit being placed upon, and co-planar with, a respective panel of said plurality of panels of the lower unit;

a. projecting tongue or strip on an adjoining edge of one said unit received in a respective channel or slot of a superimposed unit; and upright edge portions on said panels with a plug-and-socket interengagement such that superimposed said panels engage with one another, said plug-and-socket engagement having associated therewith respective rotary catch members engaging in slots provided adjacent the ends of said strips to prevent vertical separation of the units and rotatable so as to be cut of engagement with said slots to permit vertical separation of the units.

6. A display structure according to claim 5 wherein the pivotal connection of each of said pivotally connected panels with the or each adjoining said panel of a said unit is effected by means of a respective connecting member spanning the junction between the panels at the respective end of the junction between the panels, each said connecting member being pivotally connected with each of its respective panels for pivoting about a respective axis of the panel adjacent said junction and parallel therewith, and the adjoining edges of the panels at said junction being provided with intermeshing gear formations coaxial with the pivots of the respective connecting members, and wherein said connecting members comprise said rotary catch members, whereby rotary movement of the catch members between their locking and unlocking positions occurs automatically as a consequence of folding up and unfolding the display structure.

* * * * *